United States Patent [19]

Hughes et al.

[11] Patent Number: 4,732,358

[45] Date of Patent: Mar. 22, 1988

[54] SHELF BRACKET

[75] Inventors: Robert T. Hughes, Thomasville; Timothy K. Crooks, Winston-Salem, both of N.C.

[73] Assignee: Hughes Supply Co. of Thomasville, Inc., Thomasville, N.C.

[21] Appl. No.: 76,532

[22] Filed: Jul. 22, 1987

Related U.S. Application Data

[63] Continuation of Ser. No. 832,019, Feb. 24, 1986, abandoned.

[51] Int. Cl.[4] ..... A47G 29/02

[52] U.S. Cl. ..... 248/243; 248/250; 211/90; 211/153; 108/108

[58] Field of Search ..... 248/243, 235, 239, 250, 248/241; 108/152, 157, 42, 108, 109; 211/90, 134, 153

[56] References Cited

U.S. PATENT DOCUMENTS

| | | | |
|---|---|---|---|
| D. 263010 | 2/1982 | Marsh . | |
| 598,742 | 2/1898 | Ostertag . | |
| 1,354,270 | 8/1920 | Wood . | |
| 1,398,071 | 11/1921 | Forester . | |
| 2,477,771 | 8/1949 | Sanford . | |
| 2,790,616 | 4/1957 | Cardinal, Jr. . | |
| 3,471,111 | 10/1969 | MacDonald | 248/250 X |
| 3,471,112 | 10/1969 | MacDonald et al. | 248/250 X |
| 3,870,266 | 3/1975 | MacDonald . | |
| 4,037,813 | 7/1977 | Loui et al. | 248/250 |
| 4,053,132 | 10/1977 | Del Pozzo | 248/235 |
| 4,236,773 | 12/1980 | Mertes . | |
| 4,432,523 | 2/1984 | Follows | 248/250 X |
| 4,666,117 | 5/1987 | Taft | 248/250 X |
| 4,691,887 | 9/1987 | Bessinger | 108/108 X |

FOREIGN PATENT DOCUMENTS

| | | |
|---|---|---|
| 1283148 | 3/1961 | France . |

*Primary Examiner*—Ramon S. Britts
*Assistant Examiner*—Karen J. Chotkowski

[57] ABSTRACT

A molded shelf bracket is presented which includes a resilient lateral retainer which prevents side-to-side movement of cabinet shelves or the like. The lateral retainer is hingedly mounted to the shelf bracket and provides a relatively inexpensive and convenient shelf mounting bracket with the steadiness and function of expensive workmanship and quality.

8 Claims, 4 Drawing Figures

FIG. 1
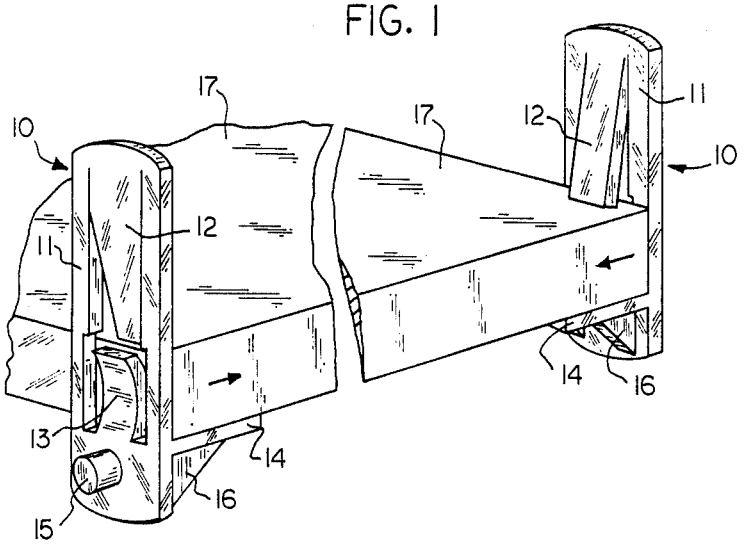
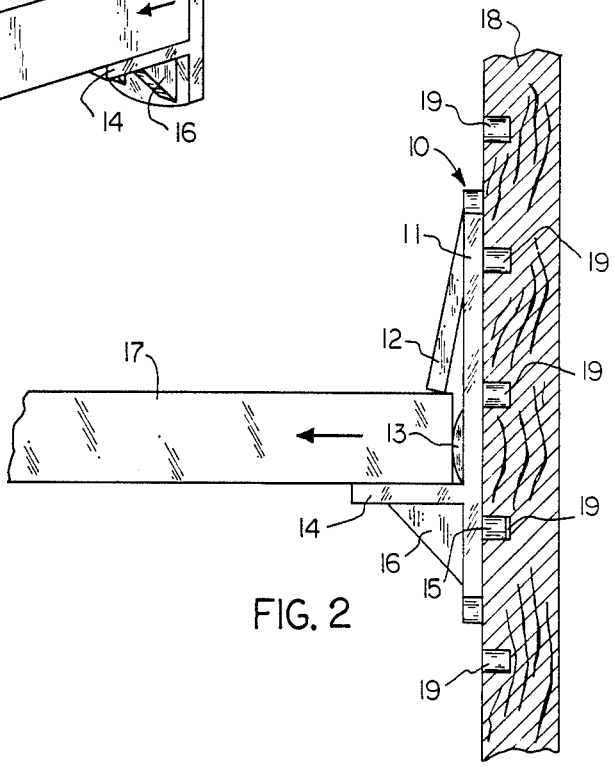
FIG. 2
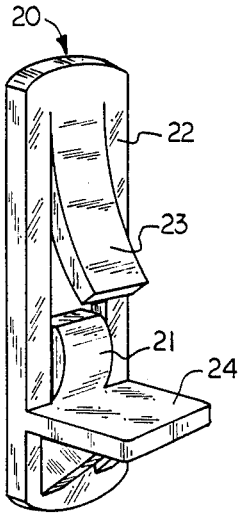
FIG. 3
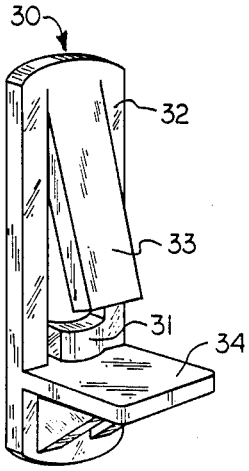
FIG. 4

SHELF BRACKET

This is a continuation of application Ser. No. 832,019, filed Feb. 24, 1986, now abandoned.

BACKGROUND OF THE INVENTION

1. Field Of The Invention

This invention relates to an improved shelf bracket which is molded from a plastic material and provides improved stability for a shelf mounted within a cabinet.

2. Description Of The Prior Art And Objectives Of The Invention

Brackets for holding shelves in bookcases, cabinets or the like are well known and have been designed in the past with cost and ease of use uppermost in the minds of the manufacturers. At first such shelf brackets were concerned with simply holding a shelf at a desired elevation as shown in U.S. Pat. No. 598,742. Later, improvements over shelf brackets were conceived such as shown in U.S. Pat. Nos. 4,037,813 and 4,053,132. These devices along with the bracket of U.S. Pat. No. 3,471,112 were concerned with both maintaining the shelf in a level position and also preventing it from moving upwward by a series of fingers or vertical stops.

Once preformed or molded shelf brackets became accepted in the lower or less expensive lines of furniture, their ease and convenience led manufacturers to begin using them in moderatly and higher priced furniture thus placing increased demands on the brackets for uniformity, tolerance standards and performance. For example the purchaser of an inexpensive cabinet may not be concerned if the shelves appear loose or shake before the shelves are loaded whereas the purchaser of a more expensive cabinet might be quite concerned with the steadiness of the shelves. In most prior art shelf bracket applications the shelf has been provided with good vertical stability but little attention was paid to the lateral tolerances. In the event a shelf was cut slightly shorter than desired, lateral (side-to-side) movement of the shelf would occur thus giving the impression of an inexpensive or low end cabinet, thereby creating resistance for their use in quality furniture lines.

With the disadvantages and limitations of prior art shelf brackets the present invention was conceived and one of its objectives is to provide a shelf bracket with can be easily adapted to conventional cabinet constructions.

It is still another objective of the present invention to provide a shelf bracket which is molded from plastic or the like and includes a hinged lateral retainer which is resilient in operation.

It is yet another objective of the present invention to provide a shelf bracket which will support a large vertical weight and will accomodate shelves of varying lengths within certain prescribed tolerances.

Other advantages and objectives of the invention will be apparent to those skilled in the art as a more detailed description of the invention is set forth below.

SUMMARY OF THE INVENTION

The present invention comprises a shelf bracket which is molded from plastic or the like and includes a body member having resiliently attached thereto a bowed, spring-like lateral retainer or restraint, a vertical retainer or restraint, a horizontal support member and a mounting pin for engaging the ends of cabinet shelves or the like to maintain the shelf in a stable position with lateral tension applied thereto.

BRIEF DESCRIPTION OF THE DRAWINGS

FIG. 1 demonstrates sections of end portions of a typical shelf with each end held by a shelf bracket of the invention;

FIG. 2 demonstates the shelf bracket as shown in FIG. 1 mounted on the inside wall of a typical cabinet;

FIG. 3 demonstrates a perspective view of another embodiment of the invention; and FIG. 4 demonstrates a perspective view of yet a third embodiment of the invention.

DESCRIPTION OF THE PREFERRED EMBODIMENT

The preferred form of the invention is shown in FIGS. 1 and 2 and comprises a molded plastic shelf bracket having a body portion, and a depending vertical shelf retainer. Also attached to the body portion is a lateral shelf retaining means which is mounted to the body portion of the shelf bracket to provide inward or lateral pressure to the shelf by its bowing action to retard any side-to-side motion of the shelf. A horizontal shelf support is connected to the body portion of the shelf bracket and on the back or opposite is mounting pin for placing the shelf bracket at a desired level in the cabinet.

DETAILED DESCRIPTION OF THE DRAWINGS

FIG. 1 depicts a typical shelf 17 held by self brackets 10 as may be used in a conventional cabinet (not shown). Brackets 10 are positioned at a suitable level within the cabinet and are maintained therein by pin slots 19 as shown in FIG. 2. Shelf brackets 10 may be integrally molded from polyethylene or any suitable plastic and as further shown in FIG. 1 includes body portion 11 and resiliently affixed vertical retaining means 12. Vertical retaining means 12 is movable and can be urged into the opening of body portion 11 for example when shelf 17 is fitted therein. Once shelf 17 slides into place onto horizontal support means 14, vertical retaining means 12 returns to it protuding position and engages shelf 17 preventing upward movement thereof as more clearly shown in FIG. 2. Retaining means 12 can be pressed back into body portion 11 as required to lift shelf 17 as for shelf removal.

To prevent lateral or side-to-side movement of shelf 17 as shown by arrows placed along the edge of shelf 17, lateral retaining means 13 is resiliently, hingedly joined to body portion 11 of bracket 10 above horizontal support means 14. Thus, a shelf pressing lateral retaining means 13 causes it to pivot from its natural postion and in attempting to return thereto, lateral retaining means 13 applies pressure or tension to the shelf. Once lateral retaining means 13 pivots to the limit of its hinged connection or is stopped by cabinet wall 18 as shown in FIG. 2, additional resiliency is provided by its bowed configuration. Lateral retaining means 13 is bowed for applying tension or an inward pressure to shelf 17 as shown in FIG. 1 thereby preventing shelf 17 from lateral movement and providing a cabinet appearance (shelf steadiness) of superior construction and quality and eliminating the necessity of having shelves cut to exact, precise lengths. For example shelves having 1/16 to ⅛" length variations would be equally stable and of course the length differences would depend on or be tolerable in accordance with the exact size and resilience of a particular lateral retaining means.

A second embodiment of a shelf bracket is shown in FIG. 3 in which shelf bracket 20 includes vertical retaining means 23 mounted onto solid body portion 22 of shelf bracket 20. Below vertical retaining means 23 is affixed lateral retaining means 21 which is integrally molded with horizontal support means 24 and attached thereto and to body portion 22. Lateral retaining means 13 as shown in FIG. 1 and 21 as shown in FIG. 3 are vertically attached to bracket 10 whereas lateral retaining means 31 of shelf bracket 30 as shown in FIG. 4 is integrally molded with and attached horizontally to the right side of body portion 32. Lateral retaining means 31 is not attached to horizontal support means 34 but is movable (pivotable) to some degree over horizontal support means 34.

Various changes can be made to the shelf bracket as shown herein by those skilled in the art and the examples and illustration are for explantory purposes and not intended to limit the scope of the appended claims.

We claim:

1. A shelf bracket comprising: a substantially planar body portion, said body portion defining an opening therein, vertical retaining means, said vertical retaining means joined to said body portion along the top of said opening and extending acorss said opening horizontal support means, said support means attached to said body portion, lateral retaining means, hinge means forming said lateral retaining means to said body portion above said horizontal support means along the bottom of said opening wherein said lateral retaining means extends across said opening and said lateral retaining means is spaced from said vertical retaining means.

2. A shelf bracket as claimed in claim 1 and including a mounting pin, said mounting pin attached to said body portion.

3. A shelf bracket as claimed in claim 1 and including a brace, said brace joined to said horizontal support means.

4. A shelf bracket as claimed in claim 1 wherein said lateral retaining means is bowed.

5. A shelf bracket as claimed in claim 1 wherein said lateral remaining means is integrally formed with said body portion.

6. A shelf bracket as claimed in claim 1 wherein said lateral retaining means is vertically attached to said body portion.

7. A shelf bracket as claimed in claim 1 wherein said lateral retaining means is horizontally attached to said body portion.

8. A shelf bracket comprising: a substantially planar body portion, said body portion defining an opening therein, vertical shelf retaining means, said vertical retaining means integrally formed and joined to said body portion along the inside top of said opening and extending across said opening, horizontal supporting means, said horizontal support means integrally formed and attached to said body portion below said opening, lateral shelf retaining means, hinge means integrally joining said lateral retaining means to said body portion along the inside bottom of said opening, wherein said lateral retaining means extends across said opening, said vertical and said lateral retaining means spaced from each other, a brace, said brace mounted below said horizontal support means and joined thereto and to said body portion.

* * * * *